United States Patent [19]

Vail, Sr. et al.

[11] Patent Number: 4,767,014

[45] Date of Patent: Aug. 30, 1988

[54] SLEEVE AND BOTTOM-COVER FOR IN A MODULAR DISPLAY RACK WITH PAINTED ARMS AND PAINTED BOTTOM

[76] Inventors: Kenneth E. Vail, Sr., 2560 Los Lomitas Way, Covina, Calif. 91724; Kenneth E. Vail, Jr., 758 Level Ave., Covina, Calif. 91723

[21] Appl. No.: 57,396

[22] Filed: Jun. 2, 1987

[51] Int. Cl.[4] ..... A47F 5/00

[52] U.S. Cl. ..... 211/207; 211/190

[58] Field of Search ..... 211/208, 207, 190, 187, 211/193, 204; 108/144; 403/108, 109

[56] References Cited

U.S. PATENT DOCUMENTS 3,807,574 4/1974 Lanza ..... 211/207

4,183,689 1/1980 Wirges et al. ..... 108/144 X

*Primary Examiner*—Robert W. Gibson, Jr.

*Attorney, Agent, or Firm*—W. Edward Johansen

[57] ABSTRACT

The present invention is a plurality of plastic sleeves for use in a modular display rack which is used for displaying and selling merchandise. The modular display rack includes a plurality of painted bottoms and a plurality of painted arms. The modular display rack also includes a plurality of painted base-members and a plurality of painted arm-support. Each painted bottom has a hole through which a screw securely fixes one of the painted arms thereto. A coupling mechanism slidably and telescopically couples each of the painted arms to one of the painted bottoms. Each plastic sleeve has a slot which is aligned with the hole of one of the painted bottoms so that the shaft of the screw travels therewithin. Each plastic sleeve protects one of the painted arms and one of the painted bottoms from being scratched when the modular display rack is either being set up or in use.

1 Claim, 1 Drawing Sheet

SLEEVE AND BOTTOM-COVER FOR IN A MODULAR DISPLAY RACK WITH PAINTED ARMS AND PAINTED BOTTOM

BACKGROUND OF THE INVENTION

1. Field of the Invention

The present invention relates to a modular display rack which includes a plurality of painted bottoms and a plurality of painted arms and which is for the displaying and selling of merchandise and more particularly to a plurality of plastic sleeves and a bottom-cover for slidably coupling each of painted arms to one of the painted bottoms in order to protect them from being scratched when the modular display rack is either being set up or in use.

2. Description of the Prior Art

U.S. Pat. No. 3,807,574, entitled Costumer, issued to Alfred O. Lanza on Apr. 30, 1974, teaches a costumer for displaying merchandise which has a common housing and two independently vertically adjustable stems in the common housing. These stems have independent locking mechanisms and cantilevered display arms. These stems may readily be adjusted relative to the housing and each other in accordance with the merchandise exhibited for maximum display utilization and effect.

U.S. Pat. No. 3,807,574, entitled Coat Hanger Stand, issued to Hiroshi Okazaki on Aug. 14, 1979, teaches a coat hanger stand which includes a base, a pair of spaced tubular uprights on the base, a pair of inner-tube members telescopically received in the respective uprights, a cross bar attached to the inner-tube members for carrying coat hangers and a height adjusting mechanism for releasably locking the inner-tube members at selected heights within the uprights.

A great variety of different designs of display racks for merchandise have been proposed, which satisfy various objectives. Thus it is desirable both to display the merchandise attractively, and also to provide an actual point of sale, whereby the merchandise can be sold directly off the display, and thus incorporates its own storage capacity, and it is desirable also to incorporate some form of advertising display at such point of sale. In addition to all of those factors however which are more or less self-evident, in the past, have been achieved to a certain extent in a variety of different ways it also desirable that when setting up a new sales programme, the manufacturer or supplier shall be able to provide to the vendor or retailer a complete package consisting of an inventory of the merchandise itself, and also display rack particularly designed to both display and sell the product with the maximum of customer appeal.

U.S. Pat. No. 4,655,354, entitled Foldable Display Rack, issued to Maurice Cohen on Apr. 7, 1987, teaches a preassembled, foldable display rack which is movable to and from an open display position and a folded closed position without the assembly or disassembly of any of the component parts thereof. The display rack includes a plurality of vertical support members which are pivotally interconnected by cross members. The cross members to which the vertical support members are secured define a parallelogram and is pivotally movable from the folded closed position to the open display position. Each of the cross members has a flexible pad located in an end thereof which is engageable with an adjacent cross member so that when the cross members are pivotally moved from the folded closed position to the open display position, the flexible pads frictionally engage the adjacent cross members to lock the cross members and support members to which they are joined in the open display position.

U.S. Pat. No. 4,313,544, entitled Display Rack, issued to Richard D. A. Ashton on Feb. 2, 1982, teaches a display rack which has a back wall and at least two side walls and which has a plurality of hinge mechanisms inter connecting between the respective side walls and the back wall. The hinge mechanism are located at spaced part intervals whereby the side walls may be swung flat against the back wall for shipping and may be swung away there from for erection. The shelving is dimensioned in order to fit between the two side walls when the same are swung away the shelving has fastener integral therewith interengageable with the side wall whereby the shelving may be secured along either side edge to respective side walls, in supporting relation thereto, and at the same time interlocking such side walls together in predetermined spaced apart relation so that they are no longer swingable with respect to the back wall, and forming a rigid three-dimensional structure.

U.S. Pat. No. 4,324,076, entitled Wall Units, issued to Rueben Honickman on Apr. 13, 1982, teaches a closet structure which is installed in a building which has an alcove defined by first and second sidewalls and a back wall of the building. The closet is defined by wall units which are disposed on one of each of the side walls of the alcove with the back wall remaining exposed between the wall units. Each unit is in the form of a relatively rigid self-supporting panel which is formed with an array of opening for receiving article supporting elements engaged in the opening. Each panel is coupled to the relevant one of the vertical and the inner surface spaced form the wall. The wall units may also be used in store for storing and displaying merchandise.

U.S. Pat. No. 4,344,367, entitled Modular Product Display System, issued to Milton J. Merl on Aug. 17, 1982, teaches a modular display system for beverage bottles which includes a base assembly and at least two spaced apart upright supporting webs detachably connected to the base assembly.

U.S. Pat. No. 4,351,244, entitled Shelving System issued to James A. Shuttles on Sept. 28, 1982, teaches a four-post merchandiser which includes tow light-gauge sheet metal corner posts which are reinforced against twisting by a seal camming action by which the two posts are urged tightly against the corners of thee shelves.

U.S. Pat. No. 4,359,947, entitled Shelving Assembly, issued to Howard J. Marschak on Nov. 23, 1982, teaches a shelving assembly which issued for displaying or storing merchandise in commercial establishment in any of several ways which are tailored to meet the need of that establishment. The components are capable of being combined to produce a shelving assembly with any selected number of either inclined or horizontal shelves.

U.S. Pat. No. 4,379,431, entitled Shelving Assembly, issued to John J. Clement on Apr. 12, 1983, teaches a shelving assembly which includes vertically disposed corner posts interconnected at their bottom ends by header panel. The shelving assembly is used for displaying or storing merchandise in commercial establishments.

U.S. Pat. No. 4,384,751, entitled Shelving Units and Their Use in Display Cabinets and Rearrangeable Shop Fitting, issued To Rita Cuntermann and Hermann Siekmann on May 24, 1983, teaches a shelving unit which includes a pair of ladder-like members each of which is formed from two vertical elements connected by a plurality of horizontal elements. Several interchangeable generally rectangular shelves rest upon respective opposed pairs of the horizontal elements.

U.S. Pat. No. 4,419,938, entitled Plug Assembled Sectional Display Rack, issued to Albin Kaut on Dec. 13, 1983, teaches a plug assembled multi-shelf sectional display rack which includes a plurality of horizontal and vertical hollow sections which are jointed together at their ends by corner junctions which have vertically and horizontally extending plugs engageable within the hollows of the sections.

U.S. Pat. No. 4,430,947, entitled Shelf Support System, issued to Martin C. Kvame on Feb. 14, 1984 teaches a support system for shelving which includes a first female element which is attached to the side wall or other wall of a display stand and a second male element which is attached to the side or ends of shelving which is provided for the display stand. The support system elements are designed so that they may be snapped together when the display stand is being assembled and slide apart when the display stand is being disassembled.

U.S. Pat. No. 4,444,322, entitled Display Rack, issued to Vernon E. Lee on Apr. 24, 1984, teaches a display rack for retail food merchandising which is assembled upon a novel adjustable frame structure. The display rack includes a pair of end structure assemblies and a pair of center structure assemblies, each of which includes a vertical support member attached upper and lower horizontally extendible members. The center structure assemblies are placed between and perpendicular to the end structure assemblies which are positioned parallel to each other. Each center structure assembly is securable attachable to its adjacent end structure assemblies.

U.S. Pat. No. 4,450,775, entitled Merchandise Display Rack, issued to David A. Brendle on May 29, 1984, teaches a merchandise display rack which is constructed of prefabricated materials for use in displaying merchandise and/or printed materials in stores and malls. Modular construction permits tailoring the size of the merchandise display rack according to individual needs.

SUMMARY OF THE INVENTION

In view of the foregoing factors and conditions which are characteristic of the prior art it is the primary object of the present invention to provide a plurality of plastic sleeves for slidably coupling each of a plurality of painted arms to one of a plurality of painted bottoms in order to protect both of them from being scratched when the modular display rack is either being set up or in use.

In accordance with the present invention an embodiment of a plurality of plastic sleeves for use in a modular display rack which is used for displaying and selling merchandise is described. The modular display rack includes a plurality of painted bottoms and a plurality of painted arms. The modular display rack also includes a plurality of painted base-members and a plurality of painted arm-support. Each painted bottom has a hole through which a screw securely fixes one of the painted arms thereto. A coupling mechanism slidably and telescopically couples each of the painted arms to one of the painted bottoms. Each plastic sleeve has a slot which is aligned with the hole of one of the painted bottoms so that the shaft of the screw travels therewithin. Each plastic sleeve protects one of the painted arms and one of the painted bottoms from being scratched when the modular display rack is either being set up or in use.

The features of the present invention which are believed to be novel are set forth with particularity in the appended claims.

Other claims and many of the attendant advantages will be more readily appreciated as the same becomes better understood by reference to the following detailed description and considered in connection with the accompanying drawing in which like reference symbols designate like parts throughout the figures.

DESCRIPTION OF THE PREFERRED EMBODIMENT

Figure 1:
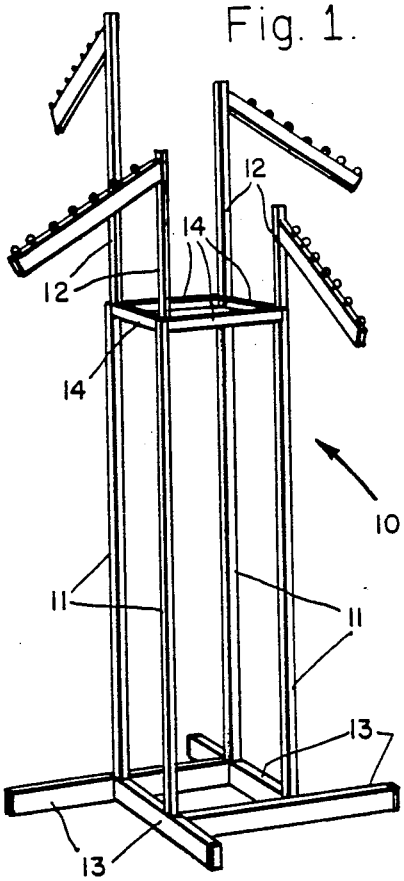
FIG. 1 is a perspective view of a modular display rack which includes a plurality of painted arms to one of a plurality of painted bottoms.

In order to best understand the present invention it is necessary to refer to the following description of its preferred embodiment in conjunction with the accompanying drawing. Referring to FIG. 1 a modular display rack 10 includes a plurality of painted bottoms 11 and a plurality of painted arms 12. The modular display rack 10 also includes a plurality of painted base-members 13 and a plurality of painted arm-support 14. Each painted bottom 11 has a hole through which a screw 16 securely fixes one of the painted arms 12 thereto 15. The modular display rack 10 is used for displaying and selling merchandise.

Figure 2:
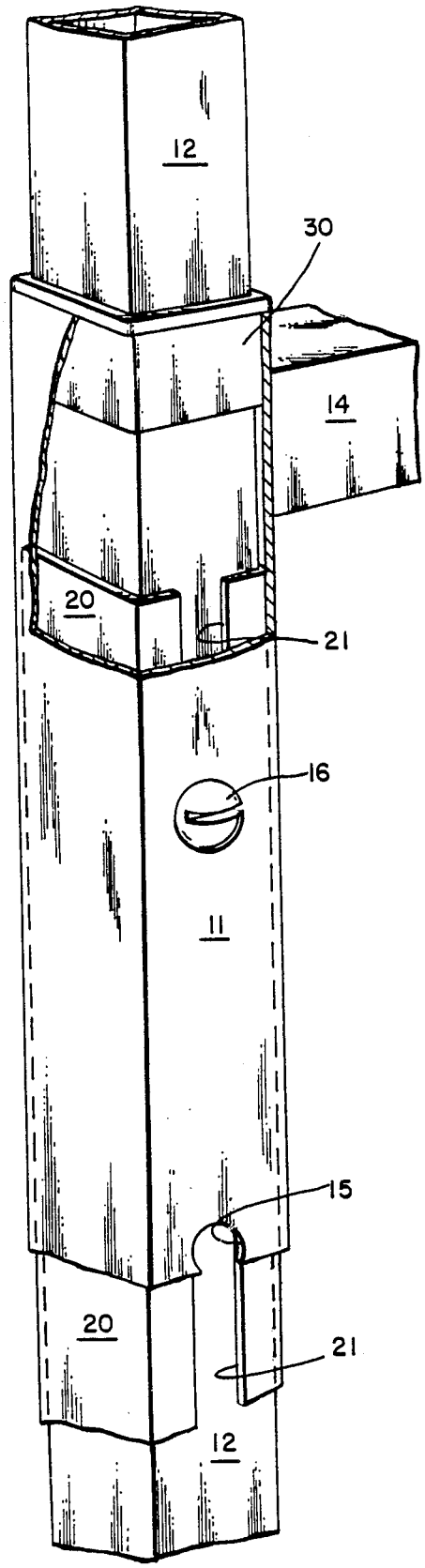
FIG. 2 is a perspective view of a sleeve and a bottom-cover which have been constructed in accordance with the principles of the present invention and slidably couples one of the plurality of painted arms to one of the plurality of painted bottoms in order to protect both of them from being scratched when the modular display rack of FIG. 1 is either being set up or in use.
Figure 3:
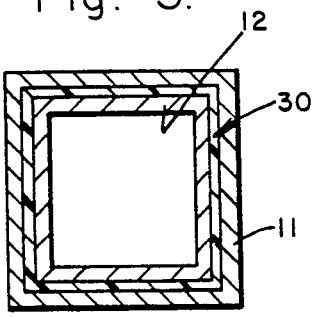
FIG. 3 is a transverse view in cross-section of the bottom-cover of FIG. 2 taken along line 3—3 of FIG. 2.
Figure 4:
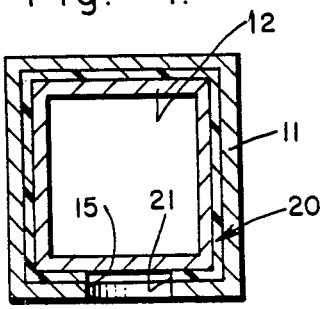
FIG. 4 is a transverse view in cross-section of the sleeve of FIG. 2 taken along line 4—4 of FIG. 2.

Referring to FIG. 1 in conjunction with FIG. 2 an improvement includes a plurality of plastic sleeves 20 with a slot 21 which is aligned with the hole 15 of each painted bottom 11 so that the shaft of the screw 16 travels therewithin and a plurality of plastic bottom-covers 30. Each plastic sleeve 20 along with one of the plastic bottom-covers 30 slidably couples one of the painted arms 12 to one of the painted bottoms 11. Each plastic sleeve 20 along with one of the bottom-covers 30 also protects one of the painted arms 12 and one of the painted bottoms 11 from being scratched when the modular display rack 10 is either being set up or in use.

From the foregoing it can be seen that a plurality of plastic sleeves and a plurality of plastic bottom-covers wherein each plastic sleeve along with one of the bottom-covers slidably couples one of a plurality of painted arms to one of a plurality of painted bottoms in order to protect both of them from being scratched when the modular display rack is either being set up or in use have been described. It should be noted that the sketches are not drawn to scale and that distance of and between the figures are not to be considered significant.

Accordingly it is intended that the foregoing disclosure and showing made in the drawing shall be considered only as an illustration of the principles of the present invention.

What is claimed is:

1. An improvement for use in a modular display rack which includes a plurality of painted bottoms, a plurality of painted arms, a plurality of painted base-members having a hole through which a screw securely fixes one of the painted arms thereto and a plurality of painted arm-supports and which is used for displaying and selling merchandise, said improvement comprising:

a. coupling means for slidably and telescopically coupling each of the painted arms to one of the painted bottoms; and b. a plurality of plastic sleeves each of which has a slot which is aligned with the hole of one of the painted bottoms so that the shaft of the screw travels therewithin and each of which protects one of the painted arms and one of the painted bottoms from being scratched when the modular display rack is either being set up or in use.

* * * * *